US009076354B1

(12) United States Patent
Peota et al.

(10) Patent No.: US 9,076,354 B1
(45) Date of Patent: Jul. 7, 2015

(54) SIGN STANCHION

(71) Applicant: Target Brands, Inc., Minneapolis, MN (US)

(72) Inventors: Robert D. Peota, Minneapolis, MN (US); Robert G. Logan, Blaine, MN (US)

(73) Assignee: Target Brands, Inc., Minneapolis, MN (US)

( * ) Notice: Subject to any disclaimer, the term of this patent is extended or adjusted under 35 U.S.C. 154(b) by 0 days.

(21) Appl. No.: 14/463,840

(22) Filed: Aug. 20, 2014

(51) Int. Cl.
*G09F 7/00* (2006.01)
*G09F 15/00* (2006.01)
*G09F 7/08* (2006.01)

(52) U.S. Cl.
CPC ..... *G09F 15/0012* (2013.01); *G09F 15/0018* (2013.01); *G09F 7/08* (2013.01)

(58) Field of Classification Search
USPC ..... 40/611.05, 611.08, 611.13, 657, 124.4, 40/606.18
See application file for complete search history.

(56) References Cited

U.S. PATENT DOCUMENTS

| | | | | |
|---|---|---|---|---|
| 1,188,695 | A * | 6/1916 | Star | 40/618 |
| 2,162,025 | A | 6/1939 | McClaughry | |
| 2,682,125 | A * | 6/1954 | Coffield | 40/618 |
| 2,388,180 | A | 10/1954 | Pulver, Jr. | |
| 2,746,189 | A * | 5/1956 | Bass | 40/622 |
| 4,059,914 | A * | 11/1977 | Dobson | 40/611.01 |
| 4,144,664 | A | 3/1979 | De Korte | |
| D279,201 | S | 6/1985 | Shuman | |
| 4,594,802 | A | 6/1986 | Field | |
| 4,604,820 | A | 8/1986 | Edman | |
| 4,669,210 | A * | 6/1987 | Van Erum | 40/618 |
| 4,726,132 | A | 2/1988 | Ernest | |
| 5,241,767 | A | 9/1993 | Fuda et al. | |
| 5,307,581 | A * | 5/1994 | Kalmykow | 40/611.01 |
| 5,456,033 | A | 10/1995 | Sachnoff | |
| 5,615,503 | A | 4/1997 | Current | |
| 5,701,695 | A | 12/1997 | Current | |
| D396,562 | S | 8/1998 | Kenney | |
| D397,562 | S | 9/1998 | DePottey et al. | |
| 5,987,794 | A | 11/1999 | Lavi et al. | |
| 6,009,651 | A | 1/2000 | Current | |
| 6,105,292 | A | 8/2000 | Current | |
| 6,282,825 | B1 | 9/2001 | Godfrey et al. | |
| 6,421,940 | B1 * | 7/2002 | Cobb et al. | 40/611.01 |
| 7,536,815 | B2 * | 5/2009 | Cheung | 40/791 |
| D639,086 | S | 6/2011 | Curbbun et al. | |
| 7,954,265 | B2 * | 6/2011 | Topcuoglu | 40/611.01 |
| 8,156,674 | B2 * | 4/2012 | Martinez, Jr. | 40/764 |
| D661,124 | S | 6/2012 | Curbbun et al. | |
| 2008/0236005 | A1 | 10/2008 | Isayev et al. | |

OTHER PUBLICATIONS

Office Action from Canadian Patent Application No. 2,868,955, mailed Jan. 29, 2015 (5 pages).

* cited by examiner

*Primary Examiner* — Kristina Junge
(74) *Attorney, Agent, or Firm* — Leanne Taveggia Farrell; Westman, Champlin & Koehler, P.A.

(57) ABSTRACT

A sign stanchion includes a support frame having a first side and a second side. A plurality of substantially horizontal backer panels are mounted to the support frame, extend between the first and second sides of the support frame and are substantially vertically spaced apart from each other. At least one sign includes a main panel, a first tab coupled to a top of the main panel by a first bend and a second tab coupled to a bottom of the main panel by a second bend. The at least one sign is mounted to at least one of the plurality of backer panels by inserting one of the first tab and the second tab between two of the plurality of backer panels.

20 Claims, 6 Drawing Sheets

SIGN STANCHION

BACKGROUND

A stanchion is a freestanding, upright fixture that provides support to an item. Stanchions are portable fixtures that can be moved around as needed. Exemplary items that can be supported by stanchions include chains, belts, nets or ropes for use in crowd control or in waiting lines as well as freestanding sign holders.

The discussion above is merely provided for general background information and is not intended to be used as an aid in determining the scope of the claimed subject matter.

SUMMARY

A sign stanchion includes a support frame having a first side and a second side. A plurality of substantially horizontal backer panels are mounted to the support frame, extend between the first and second sides of the support frame and are substantially vertically spaced apart from each other. At least one sign includes a main panel, a first tab coupled to a top of the main panel by a first bend and a second tab coupled to a bottom of the main panel by a second bend. The at least one sign is mounted to at least one of the plurality of backer panels by inserting one of the first tab and the second tab between two of the plurality of backer panels.

A display apparatus includes a pedestal and a display assembly mounted to the pedestal. The display assembly has a right side, a left side, a plurality of substantially horizontal slots that are spaced apart from each other and extend between the right side and the left side of the display assembly, at least one right side cap rotatably mounted to the right side of the display assembly and at least one left side cap rotatably mounted to the left side of the display assembly. Each of the at least one right side cap and the at least one left side cap have an opened state and a closed state. A graphic is inserted into two of the plurality of substantially horizontal slots when the at least one right side cap and the at least one left side cap are in the opened state. The graphic is secured to the display assembly when the at least one right side cap and the at least one left side cap are in the closed state.

A method of displaying at least one sign on a sign stanchion includes preparing at least one sign by bending a first tab located on a top of a main panel of the at least one sign so that the first tab is out of alignment with the main panel and bending a second tab located at a bottom of the main panel of the at least one sign so that the second tab is out of alignment with the main panel. The first tab of the at least one sign is inserted into a substantially horizontal slot in the sign stanchion. The second tab of the at least one sign is inserted into another substantially horizontal slot in the sign stanchion. The at least one sign is secured with side caps that are located on sides of the sign stanchion.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

The sign stanchion described in detail below is designed to be placed in highly trafficked areas in retail stores or other types of commercial or public buildings. The sign stanchion is an upright fixture that includes a base and a display area. The display area includes a plurality of substantially horizontal slots. The slots allow the display area of the sign stanchion to receive one or more signs that can be of different sizes to fill the display area. In one embodiment, the display area is located only on the front of the sign stanchion. In another embodiment, the display area is located on the front of the sign stanchion and the back of the sign stanchion.

Figure 1:
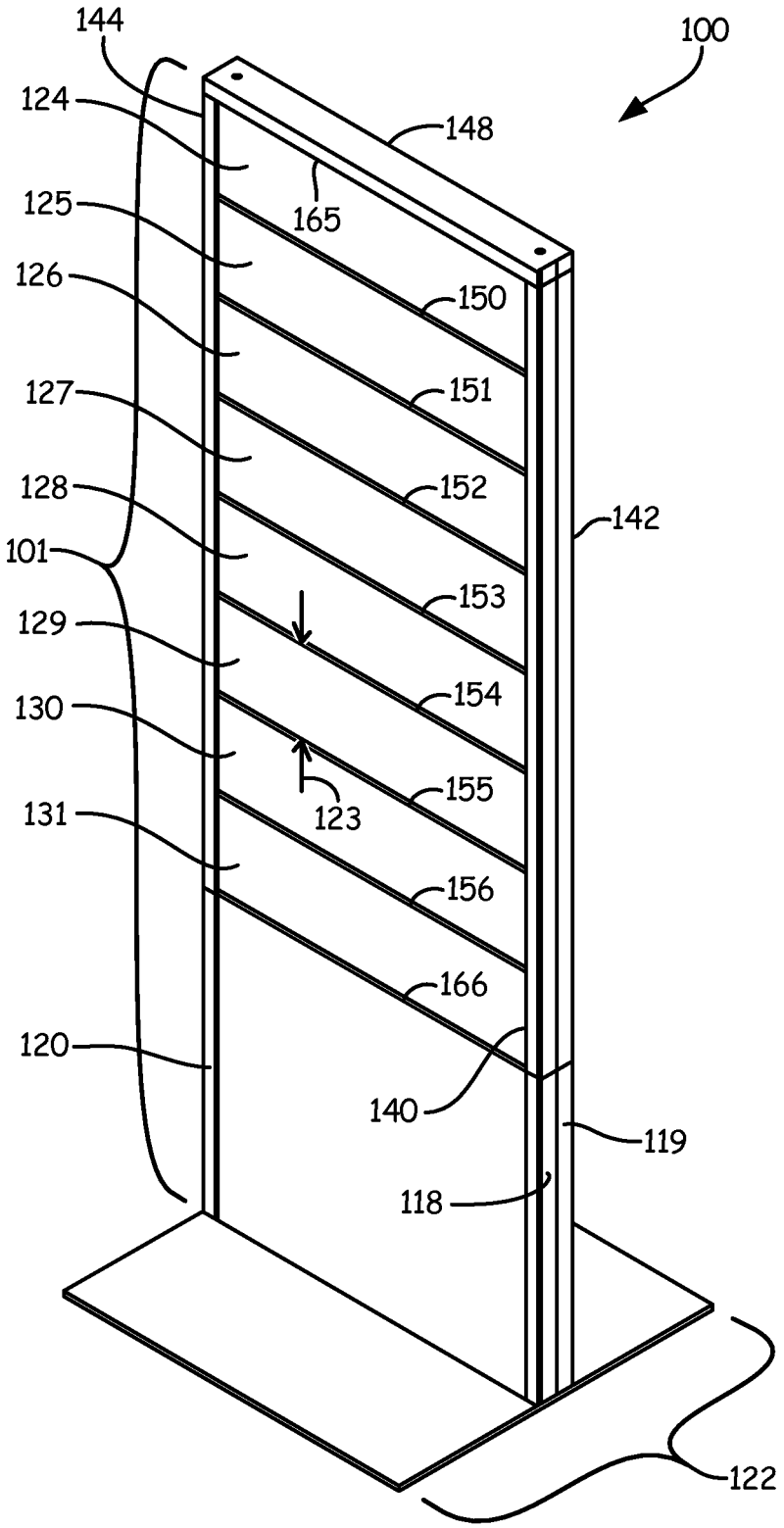
FIG. 1 is a front perspective view of a sign stanchion according to one embodiment.
Figure 4:
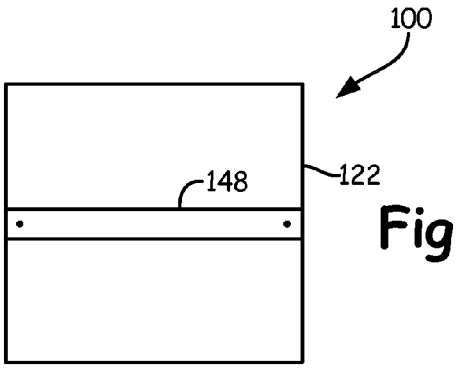
FIG. 4 is a top view of the sign stanchion illustrated in FIG. 1.
Figure 2:
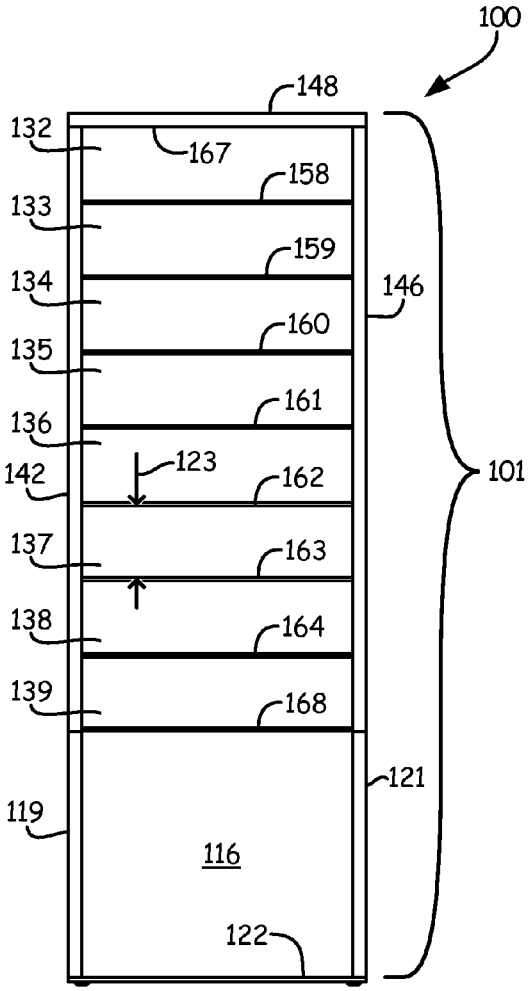
FIG. 2 is a back view of the sign stanchion illustrated in FIG. 1.
Figure 3:
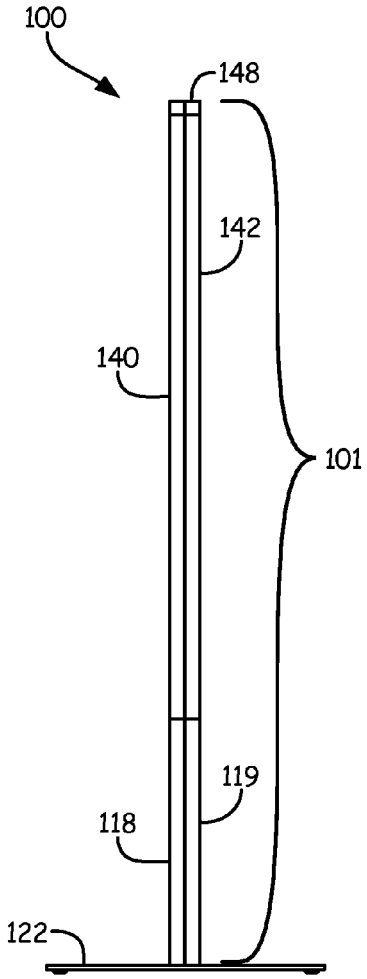
FIG. 3 is a side view of the sign stanchion illustrated in FIG. 1.

FIG. 1 is a front perspective view of a sign stanchion or display apparatus 100 according to one embodiment. Sign stanchion 100 includes a display assembly 101 mounted to a base or pedestal 122. Base 122 supports display assembly 101 in an upright position. FIGS. 2-4 are a back view, a right side view (the left side view being identical) and a top view of sign stanchion 100.

Figure 5:
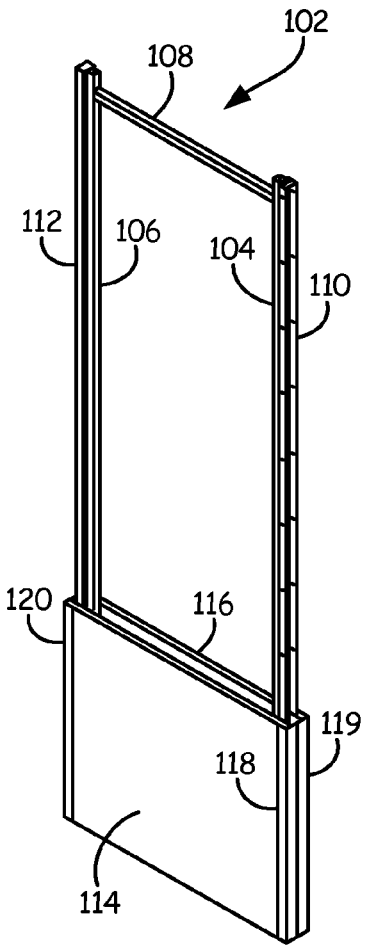
FIG. 5 is a front perspective view a support frame of the sign stanchion illustrated in FIG. 1 and according to one embodiment.
Figure 6:
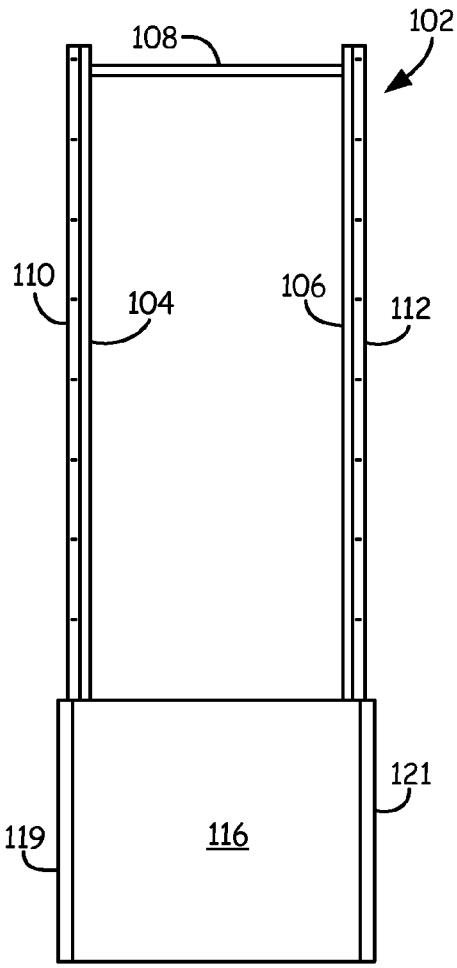
FIG. 6 is a back view of the support frame illustrated in FIG. 5.
Figure 7:
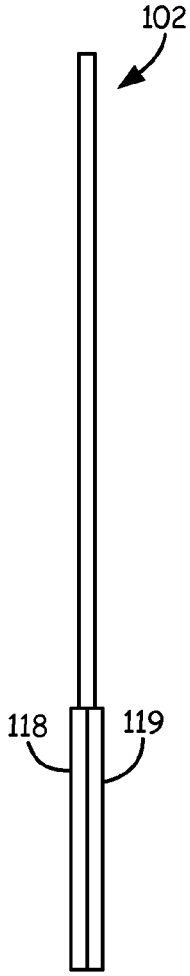
FIG. 7 is a side view of the support frame illustrated in FIG. 5.

Display assembly 101 includes an internal support frame or base frame 102. FIG. 5 is a front perspective view of exemplary support frame or base frame 102 of display assembly 101. FIGS. 6-7 are a back view and a right side view (the left side view being identical) of support frame 102. Support frame 102 includes a plurality of frame members including a right side frame member 104, a left side frame member 106 and an upper frame member 108. Support frame 102 further includes a right side channel member 110 that is mounted to and extends along a right side of right side frame member 104, a left side channel member 112 that is mounted to and extends along a left side of left side frame member 106. The open channels of right side channel member 110 and left side channel member 112 face outwardly from support frame 102. Together right side frame member 104 and right side channel member 110 define a right side of support frame 102 and left side frame member 106 and left side channel member 112 define a left side of support frame 102. Support frame 102 further includes a bottom front panel 114, a bottom back panel 116 and fixed corner members 118, 119, 120 and 121. Corner members 118, 119, 120 and 121 attach bottom front panel 114 and bottom back panel 116 to frame members 106 and 108.

With reference back to FIGS. 1-4, besides display assembly 101 including support frame 102, display assembly 101 also includes a plurality of substantially horizontal backer panels or slats 124-131 that are mounted or attached to a front of support frame 102 and extend from the right side of support frame 102 to the left side of support frame 102. Backer panels 124-131 are located between upper frame member 108 and bottom front panel 114. A plurality of substantially horizontal backer panels or slats 132-139 are also mounted or attached to a back of support frame 102 and extend from the right side of support frame 102 to the left side of support frame 102. Backer panels 132-139 are located between upper frame member 108 and bottom back panel 116. A pair of right side caps 140 and 142 are each rotatably mounted to a right side of support frame 102 above corner members 118 and 119. A pair of left side caps 144 and 146 are each rotatably mounted to a left side of support frame 102 above corner members 120 and 121. A top cap 148 is fixedly mounted to a top of support frame 102.

The plurality of substantially horizontal backer panels 124-131 are also referred to as a first set and each include a height 123. Backer panels 124-131 are substantially vertically spaced apart from each other to form substantially horizontal slots 150-156 therebetween. Therefore, slots 150-156 also extend from the right side of support frame 102 to the left side of support frame 102. In one embodiment, the substantially horizontal backer panels 124-131 are evenly spaced apart from each other to form substantially even slots 150-156. In addition, upper backer panel 124 is spaced apart from top cap 148 to form a substantially horizontal slot 165 that extends from the right side of support frame 102 to the left side of support frame 102 and lower backer panel 131 is spaced apart from bottom front panel 114 to form a substantially horizontal slot 166 that extends from the right side of support frame 102 to the left side of support frame 102. Slots 165 and 166 have the same substantially even spacing as slots 150-156.

The plurality of substantially horizontal backer panels 132-139 are also referred to as a second set and each include height 123, which is the same as the heights of each of backer panels 124-131. Backer panels 132-139 are substantially vertically spaced apart from each other to form substantially horizontal slots 158-164 therebetween. Therefore, slots 158-164 also extend from the right side of support frame 102 to the left side of support frame 102. In one embodiment, the substantially horizontal backer panels 132-139 are evenly spaced apart from each other to form even slots 158-164. In addition, upper backer panel 132 is spaced apart from top cap 148 to form a substantially horizontal slot 167 that extends from the right side of support frame 102 to the left side of support frame 102 and lower backer panel 139 is spaced apart from bottom back panel 116 to form a substantially horizontal slot 168 that extends from the right side of support frame 102 to the left side of support frame 102. Slots 167 and 168 have the same even spacing as slots 158-164.

Slots 165, 150-156 and 166 are located on the front side of sign stanchion 100 and are substantially aligned with slots 167, 158-164 and 168, respectively, that are located on the back side of sign stanchion 100. More specifically, slots 165 and 167 are substantially aligned, slots 150 and 158 are substantially aligned, slots 151 and 159 are substantially aligned, slots 152 and 160 are substantially aligned, slots 153 and 161 are substantially aligned, slots 154 and 162 are substantially aligned, slots 155 and 163 are substantially aligned, slots 156 and 164 are substantially aligned and slots 166 and 168 are substantially aligned.

The pair of right side caps 140 and 142 are also referred to as at least one first side cap or at least one right side cap. First right side cap 140 is located nearer to the front of support frame 102, while second right side cap 142 is located nearer to the back of support frame 102. As described, each of the pair of right side caps 140 and 142 are rotatable and more specifically rotatable between closed positions or closed states and opened positions or opened states. The pair of left side caps 144 and 146 are also referred to as at least one second side cap or at least one left side cap. First left side cap 144 is located nearer to the front of support frame 102, while second left side cap 146 is located nearer to the back of support frame 102. As described, each of the pair of left side caps 144 and 146 are rotatable and more specifically rotatable between closed positions or states and opened positions or states.

Figure 8A:
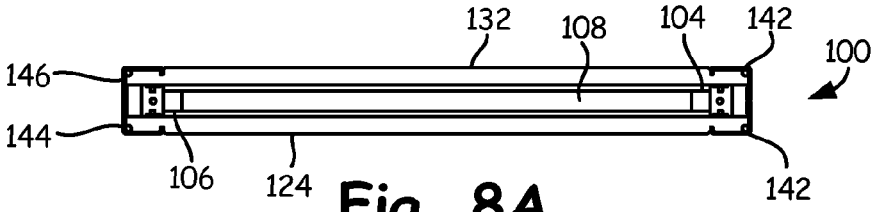
FIG. 8A illustrates a top view of the sign stanchion illustrated in FIG. 1, but with the top cap removed and the side caps in closed positions.
Figure 8B:
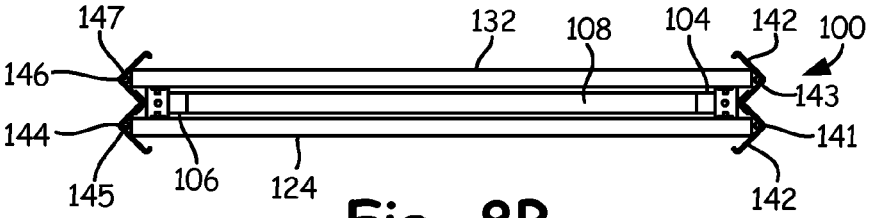
FIG. 8B illustrates a top view of the sign stanchion illustrated in FIG. 1, but with the top cap removed and the side caps in opened positions.

FIG. 8A illustrates a top view of sign stanchion 100 illustrated in FIG. 1, but with top cap 148 removed and side caps 140, 142, 144 and 146 in closed positions or closed states. FIG. 8B illustrates a top view of sign stanchion 100 illustrated in FIG. 1, but with top cap 148 removed and side caps 140, 142, 144 and 146 in opened positions or opened states. As illustrated, side caps 140, 142, 144 and 146 are rotatable about axes or pin 141, 143, 145 and 147. When first right side cap 140 and first left side cap 144, which are located on the front of sign stanchion 100, are in the opened positions, the front of display assembly 101 can receive at least one sign. When first right side cap 140 and first left side cap 144 are in the closed positions, side caps 140 and 144 secure and retain the at least one sign.

Likewise, when second right side cap 142 and second left side cap 146, which are located on the back of sign stanchion 100, are in the opened positions, the back of display assembly 101 can receive at least one sign. When second right side cap 142 and second left side cap 146 are in the closed positions, side caps 142 and 146 secure and retain the at least one sign. In one embodiment, right side caps 140 and 142 and left side caps 144 and 146 are secured into closed positions using magnets. For example, the right and lefts sides of at least one of the backer panels 124-131 on the front of display assembly 101 and the right and left sides of at least one of the backer panels 132-139 on the back of display assembly 101 may include a magnet for magnetically securing the side caps into closed positions.

Figure 9:
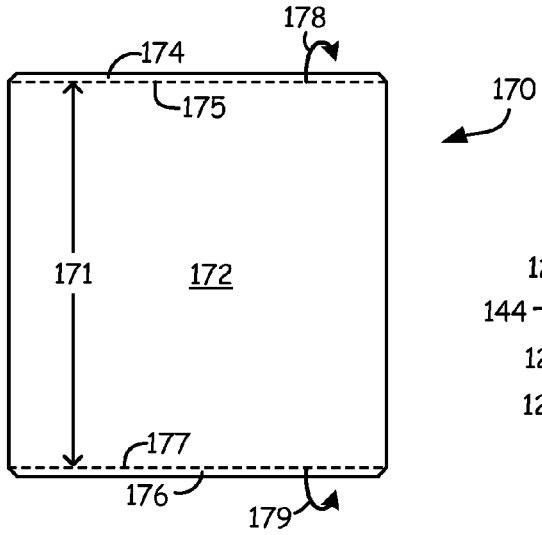
FIG. 9 illustrates a plan view of an exemplary sign or graphic according to one embodiment.
Figure 10:
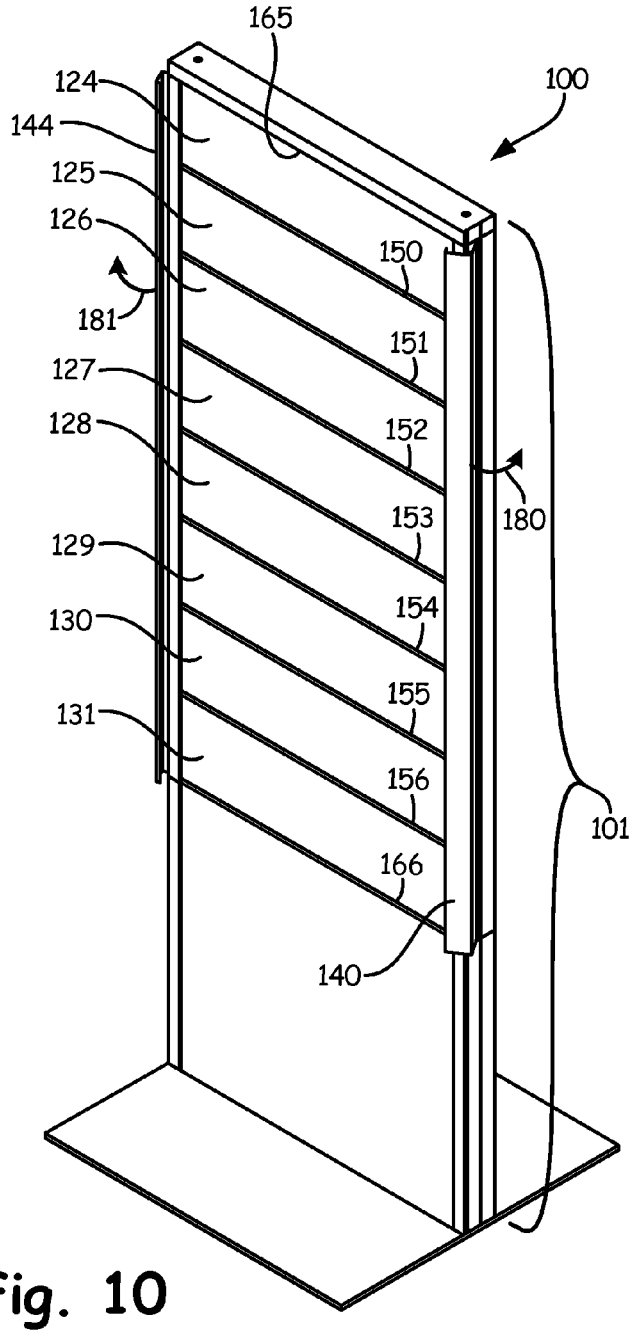
FIG. 10 illustrates a front perspective view of the sign stanchion illustrated in FIG. 1, but with a first right side cap and a first left side cap in opened positions.

Sign stanchion or display apparatus 100 includes at least one sign or graphic. FIG. 9 illustrates a plan view of an exemplary sign or graphic 170 according to one embodiment. Sign or graphic 170 includes a main panel or base area 172, a first tab or first flap 174 coupled to a top of main panel 172 by a first bend 175 and a second tab or second flap 176 coupled to a bottom of main panel 172 by a second bend 177. As illustrated in FIG. 9, first tab 174 is bent in the direction of arrow 178 and second tab 176 is bent in the direction of arrow 179. FIG. 10 illustrates a front perspective view of sign stanchion 100, but with first right side cap 140 and first left side cap 144 in opened positions. This is accomplished by rotating first side cap 140 in the direction of arrow 180 and rotating second side cap 144 in the direction of arrow 181. In the opened positions, sign or graphic 170 can be mounted to at least one of backer panels 124-131 of display assembly 101 by inserting first tab 174 into one of the plurality of slots 165 and 150-156 and inserting second tab 176 into a different one of slots 150-156 and 166 than first tab 174 was inserted. By mounting sign or graphic 170 to at least one of backer panels 124-131, sign or graphic 170 covers at least one of backer panels 124-131.

Figure 11:
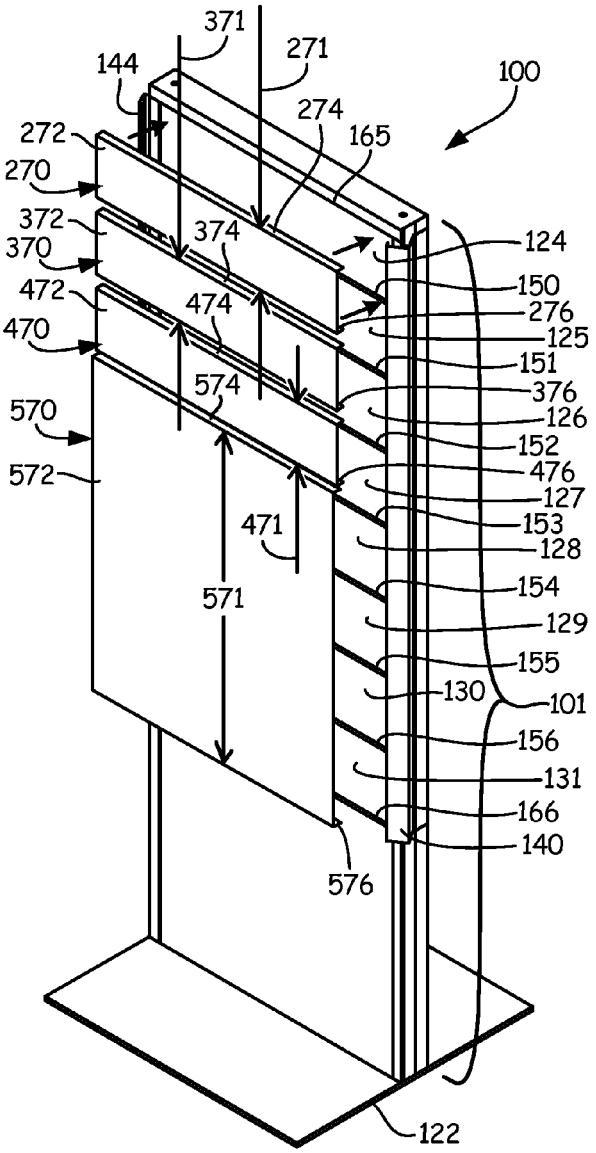
FIG. 11 illustrates a front perspective view of the sign stanchion illustrated in FIG. 1 receiving a plurality of signs according to one embodiment.

FIG. 11 illustrates a front perspective view of sign stanchion 100 receiving a plurality of signs or graphics while first right side cap 140 and first left side cap 144 are in the opened positions. In the embodiment illustrated in FIG. 11, there are four signs or graphics 270, 370, 470 and 570 that are being received by the front of display assembly 101 of sign stanchion 100. Main panel 272 of sign 270 includes a height 271. Height 271 is slightly greater than height 123 of each backer panel so that first tab 274 can be inserted into slot 165, second tab 276 can be inserted into slot 150 and main panel 272 spans or covers only one of the backer panels, specifically backer panel 124. Main panel 372 of sign 370 includes a height 371. Height 371 is slightly greater than height 123 of each backer panel so that first tab 374 can be inserted into slot 150, second tab 376 can be inserted into slot 151 and main panel 372 spans or covers only one of the backer panels, specifically backer panel 125. Main panel 472 of sign 470 includes a height 471. Height 471 is slightly greater than height 123 of each backer panel so that first tab 474 can be inserted into slot 151, second tab 476 can be inserted into slot 152 and main panel 472 spans or covers only one of the backer panels, specifically backer panel 126. Main panel 572 of sign 570 includes a height 571. Height 571 is slightly greater than the height of five backer panels including the spacing of slots between those five backer panels so that first tab 574 can be inserted into slot 152, second tab 576 can be inserted into slot 166 and main panel 572 spans or covers backer panels 127-131.

As shown in FIG. 11, the front of display assembly 101 can include one or more signs 270, 370, 470 and 570 that together span or cover all eight backer panels 124-131 on the front of display assembly 101. In addition, the back of display assembly 101 can include or more signs 270, 370, 470 and 570 that together span or cover all eight backer panels 132-139.

Figure 12:
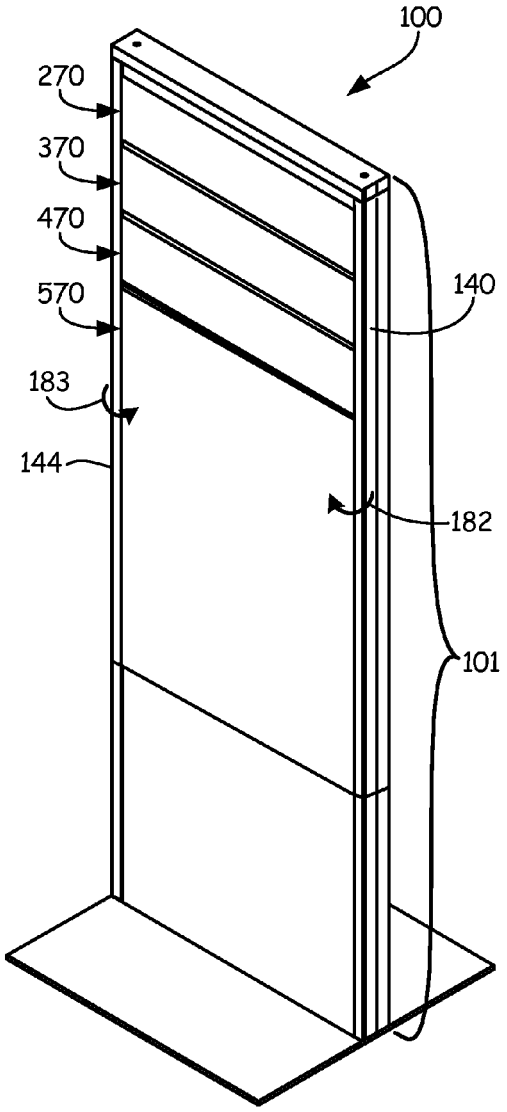
FIG. 12 illustrates a front perspective view of the sign stanchion in illustrated in FIG. 1 with the plurality of signs mounted thereto.

FIG. 12 illustrates a front perspective view of sign stanchion 100 illustrating signs or graphics 270, 370, 470 and 570 being secured to the front of display assembly 101 of sign stanchion 100. In particular, first right side cap 140 and first left side cap 144 are rotated from their opened positions to their closed positions as shown by the illustrated arrows 182 and 183.

Figure 13:
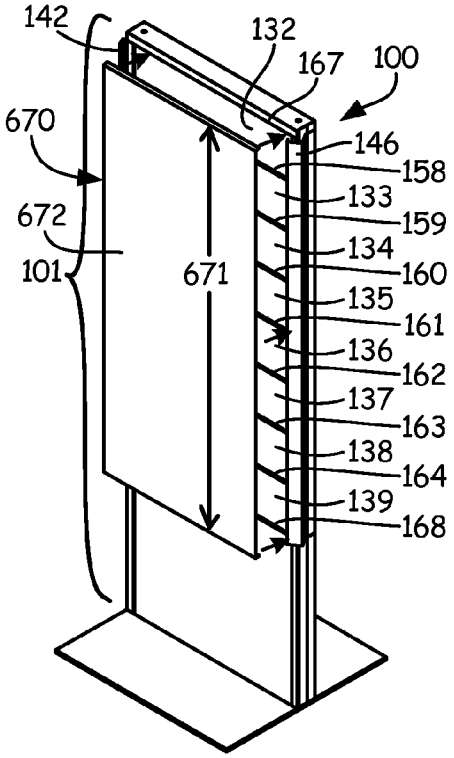
FIG. 13 illustrates a back perspective view of the sign stanchion illustrated in FIG. 1 receiving a single sign according to one embodiment.

FIG. 13 illustrates a back perspective view of sign stanchion 100 receiving a plurality of signs or graphics while second right side cap 142 and second left side cap 146 are in the opened positions. In the embodiment illustrated in FIG. 13, there is one sign or graphic 670 that is being received by the back of display assembly 101 of sign stanchion 100. Main panel 672 of sign 670 includes a height 671. Height 671 is slightly greater than the height of all eight backer panels 132-139 including the spacing of slots 158-164 between those eight backer panels 132-139 so that first tab 674 can be inserted into slot 167, second tab 676 can be inserted into slot 168 and main panel 672 spans or covers backer panels 132-139.

As such, main panel 172 of exemplary sign 170 illustrated in FIG. 9 can have height 171 that spans or covers one or more of the plurality of backer panels 132-139, such as all eight of backer panels 132-139 on the back of display assembly 101. In addition, the front of display assembly 101 can include one or more signs 670 that together span or cover all of backer panels 124-131 on the front of display assembly 101.

Figure 14:
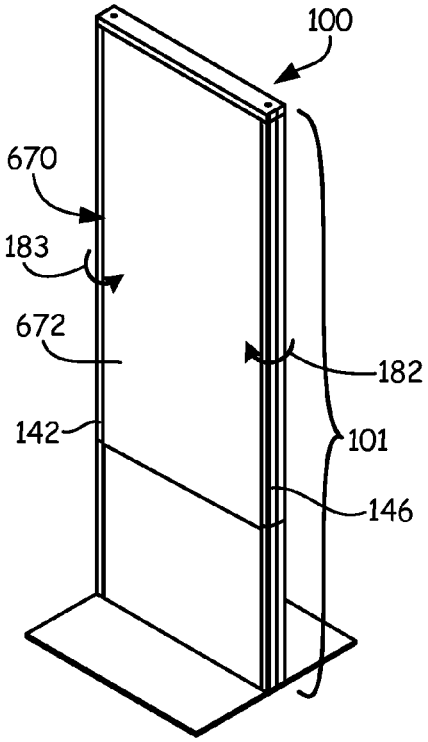
FIG. 14 illustrates a back perspective view of the sign stanchion illustrated in FIG. 1 with the single sign being mounted thereto.

FIG. 14 illustrates a back perspective view of sign stanchion 100 illustrating sign or graphic 670 being secured to the back of sign stanchion 100. In particular, second right side cap 142 and second left side cap 146 are rotated from their opened positions to their closed positions as shown by the illustrated arrows 184 and 185.

Figure 15:
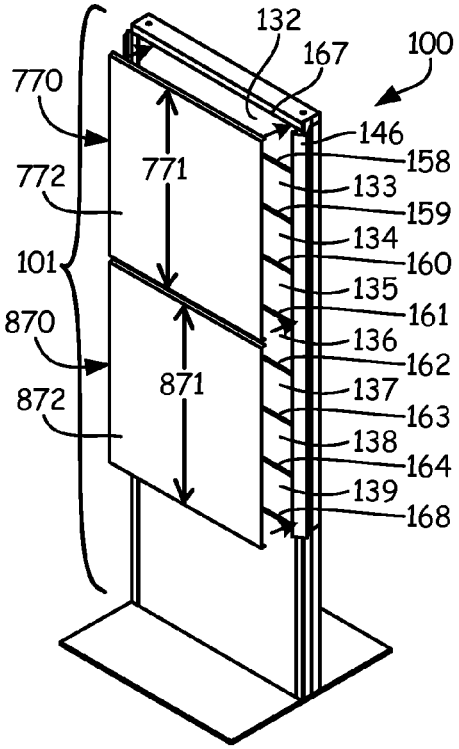
FIG. 15 illustrates a back perspective view of the sign stanchion illustrated in FIG. 1 receiving two signs according to one embodiment.

FIG. 15 illustrates a perspective view of the back of sign stanchion 100 receiving a plurality of signs or graphics while second right side cap 142 and second left side cap 146 are in the opened positions. In the embodiment illustrated in FIG. 15, there are two signs or graphics 770 and 870 that are being received by the back of display assembly 101 of sign stanchion 100. Main panel 772 of sign 770 includes a height 771. Height 771 is slightly greater than the height of four backer panels 132-135 including the spacing of slots 158-160 between those four backer panels 132-135 so that first tab 774 can be inserted into slot 167, second tab 776 can be inserted into slot 161 and main panel 772 spans or covers backer panels 132-135. Main panel 872 of sign 870 includes a height 871. Height 871 is slightly greater than the height of four backer panels 136-139 including the spacing of slots 162-164 between those four backer panels 136-139 so that first tab 874 can be inserted into slot 161, second tab 876 can be inserted into slot 168 and main panel 872 spans or covers backer panels 136-139.

As such, main panel 172 of exemplary sign 170 illustrated in FIG. 9 can have height 171 that spans or covers one or more of the plurality of backer panels 132-139, such as four of backer panels 132-139 on the back of display assembly 101. For example, the back of display assembly 101 can include one or more signs 770 and 870 that together span or cover all eight backer panels 132-139. In addition, the front of display assembly 101 can include on ore more signs 770 and 870 that together span or cover all of backer panels 124-131 located on the front of display assembly 101.

Figure 16:
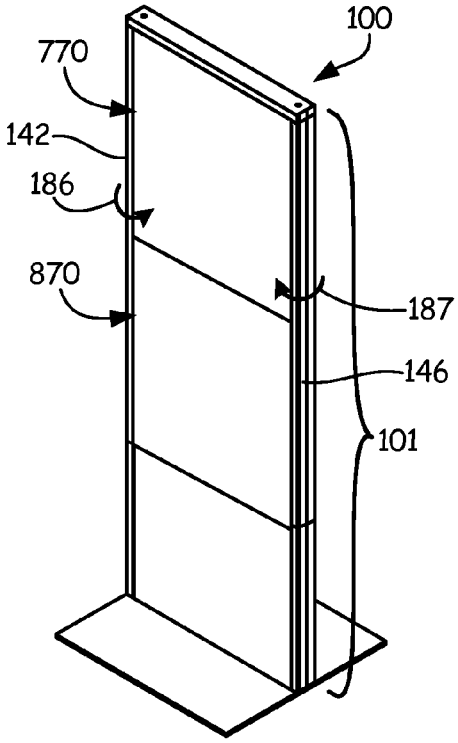
FIG. 16 illustrates a back perspective view of the sign stanchion illustrated in FIG. 1 with the two signs being mounted thereto.

FIG. 16 illustrates a back perspective view of sign stanchion 100 illustrating signs or graphics 770 and 870 being secured to the back of sign stanchion 100. In particular, second right side cap 142 and second left side cap 146 are rotated from their opened positions to their closed positions as shown by the illustrated arrows 186 and 187.

A method of displaying at least one sign on a sign stanchion is provided. With reference to FIG. 9, the method includes preparing at least one sign by bending a first tab 174 located on a top of main panel 172 of at least one sign 170 so that first tab 174 is out of alignment with the main panel 172 and bending a second tab 176 located at a bottom of main panel 172 of at least one sign 170 so that second tab 176 is out of alignment with main panel 172. The method includes inserting first tab 174 into one of the substantially horizontal slots in sign stanchion 100 and second tab 176 into another of the substantially horizontal slots in sign stanchion 100. The at least one sign 170 is secured to sign stanchion 100 with side caps that are located on sides of the sign stanchion.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A sign stanchion comprising:

a support frame having a substantially vertical left side frame member, a substantially vertical right side frame member and a substantially horizontal upper frame member that connects the left side frame member to the right side frame member;

a plurality of substantially horizontal backer panels mounted to the support frame and extending between the left side frame member and the right side frame member of the support frame, wherein the plurality of substantially horizontal backer panels are substantially vertically spaced apart from each other and have planar front surfaces that are vertically aligned with each other; and at least one sign including a main panel having a top edge and a bottom edge, a first tab coupled to the top edge of the main panel by a first bend and a second tab coupled to the bottom edge of the main panel by a second bend; and wherein the at least one sign is mounted to at least one of the plurality of backer panels by inserting one of the first tab and the second tab between two of the plurality of backer panels.

2. The sign stanchion of claim 1, wherein the main panel of the at least one sign comprises a height that spans one or more of the plurality of substantially horizontal backer panels.

3. The sign stanchion of claim 1, wherein the plurality of substantial horizontal backer panels comprise a first set of the plurality of substantially horizontal backer panels that are mounted to a front of the support frame with their planar front surfaces facing a front of the sign stanchion and a second set of the plurality of substantially horizontal backer panels that are mounted to a back of the support frame with their planar front surfaces facing a back of the sign stanchion.

4. The sign stanchion of claim 3, wherein the at least one sign comprises a plurality of signs that together cover one of the first set and the second set of the plurality of substantially horizontal backer panels.

5. The sign stanchion of claim 1, further comprising at least one first side cap mounted to the first side of the support frame and at least one second side cap mounted to the second side of the support frame, the at least one first side cap and the at least one second side cap being rotatable between a closed position and an opened position.

6. The sign stanchion of claim 5, wherein the at least one sign is mounted to the at least one of the plurality of substantially horizontal backer panels when the at least one first side cap and the at least one second side cap are in the opened position.

7. The sign stanchion of claim 6, wherein the at least one sign is secured to the at least one of the plurality of substantially horizontal backer panels when the at least one first side cap and the at least one second side cap are in the closed position.

8. The sign stanchion of claim 7, wherein the at least one first side cap and the at least one second side cap are magnetically secured in the closed position.

9. A display apparatus comprising:

a pedestal;

a display assembly mounted to the pedestal and comprising:

a base frame having a right side; and a left side;

a plurality of substantially horizontal slats mounted to the base frame, extending from the right side to the left side of the base frame and having planar front surfaces that are vertically aligned with each other, wherein the plurality of substantially horizontal slats are vertically spaced apart from each other on the base frame to form a plurality of substantially horizontal slots that are each defined by at least an upper or a lower edge of at least one of the plurality of substantially horizontal slats;

at least one right side cap rotatably mounted to the right side of the display assembly and having an opened state and a closed state;

at least one left side cap rotatably mounted to the left side of the display assembly and having an opened state and a closed state;

wherein in the opened states of the at least one right side cap and the at least one left side cap the plurality of substantially horizontal slots are fully uncovered by the side caps and wherein in the closed states of the at least one right side cap and the at least one left side cap end portions of the plurality of substantially horizontal slots are covered by the side caps; and a graphic that is inserted into two of the plurality of substantially horizontal slots when the at least one right side cap and the at least one left side cap are in the opened state and is secured to the display assembly when the at least one right side cap and the at least one left side cap are in the closed state.

10. The display apparatus of claim 9, wherein the at least one first side cap and the at least one second side cap are magnetically secured in the closed state.

11. The display apparatus of claim 9, wherein the base frame further comprises a front and a back, wherein the plurality of horizontal slats are attached to the front and the back of the base frame between the right side and the left side of the base frame.

12. The display apparatus of claim 11, wherein the at least one right side cap mounted to the right side of the display assembly comprises first and second right side caps and the at least one left side cap mounted to the left side of the display assembly comprises first and second left side caps, wherein the first right side cap and the first left side cap are located nearer to the front of the base frame than the back of the base frame and the second right side cap and the second left side cap are located nearer to the back of the base frame than to the front of the base frame.

13. The display apparatus of claim 9, wherein the graphic comprises a base area, a first flap coupled to a top of the base area by a first bend, a second flap coupled to a bottom of the base area by a second bend.

14. The display apparatus of claim 13, wherein the graphic is mounted to at least one of the substantially horizontal slats by inserting the first flap into one of the substantially horizontal slots and the second flap into another of the substantially horizontal slots.

15. The display apparatus of claim 14, wherein the graphic comprises a plurality of graphics that are mounted to the display assembly to cover one or more of the plurality of substantially horizontal slats.

16. The display apparatus of claim 9, wherein the display assembly further comprises a bottom panel located below the plurality of substantially horizontal slats and being coupled to the base frame by fixed corner members located below the at least one rotatable right side cap and the at least one rotatable left side cap, wherein the bottom panel and fixed corner members position the plurality of substantially horizontal slats a distance above a floor to which the pedestal is located.

17. A method of displaying at least one sign on a sign stanchion, the method comprising:

preparing at least one sign by bending a first tab located on a top of a main panel of the at least one sign so that the first tab is out of alignment with the main panel and bending a second tab located at a bottom of the main panel of the at least one sign so that the second tab is out of alignment with the main panel;

inserting the first tab of the at least one sign into one of a plurality of substantially horizontal slots in the sign stanchion, the plurality of substantially horizontal slots are defined by a plurality of substantially horizontal slats mounted to a base frame of the sign stanchion, extending from a right side to a left side of the base frame, vertically spaced apart from each other and having planar front surfaces that are vertically aligned with each other;

inserting the second tab of the at least one sign into another of the plurality of substantially horizontal slots in the sign stanchion; and securing the at least one sign with side caps that have opened positions and closed positions and are located on sides of the sign stanchion, wherein in the opened positions the substantially horizontal slots are fully uncovered by the side caps and in the closed positions the side caps extend over end portions of the substantially horizontal slots.

18. The method of claim 17, wherein preparing the at least one sign comprises preparing a plurality of signs by bending a first tab located on a top of a main panel of each sign so that the first tab is out of alignment with the main panel of each sign and bending a second tab located at a bottom of the main panel of each sign so that the second tab is out of alignment with the main panel of each sign.

19. The method of claim 17, wherein inserting the first tab and the second tab of the at least one sign into substantially horizontal slots in the sign stanchion comprises inserting the first tab and the second tab of the at least one sign into substantially horizontal slots in the sign stanchion so that the at least one sign covers one or more of a plurality of substantially horizontal backer panels that define the plurality of substantially horizontal slots.

20. The method of claim 17, wherein securing the at least one sign with the side caps comprises magnetically securing the side caps to the sign stanchion.

* * * * *